United States Patent [19]

Yamada et al.

[11] Patent Number: 4,960,158

[45] Date of Patent: Oct. 2, 1990

[54] PROCESS FOR PRODUCING A ZINC-PLATED STEEL SHEET WITH AN AGEING RESISTANCE BY HOT DIP-TYPE, CONTINUOUS ZINC PLATING

[75] Inventors: Teruaki Yamada, Hyogo; Osamu Akisue, Kanagawa; Toshiyasu Ukena, Hyogo; Masahiko Oda, Hyogo; Teruki Hayashida, Hyogo, all of Japan

[73] Assignee: Nippon Steel Corporation, Tokyo, Japan

[21] Appl. No.: 319,946

[22] Filed: Mar. 7, 1989

[30] Foreign Application Priority Data

Sep. 28, 1988 [JP] Japan ..... 63-243471

[51] Int. Cl.[5] ..... C21D 9/52

[52] U.S. Cl. ..... 148/156; 148/157

[58] Field of Search ..... 148/156, 157, 12.1

[56] References Cited

FOREIGN PATENT DOCUMENTS 10447 2/1983 Japan .

39890 9/1983 Japan .

52527 3/1985 Japan .

276935 12/1986 Japan .

*Primary Examiner*—R. Dean

*Attorney, Agent, or Firm*—Wenderoth, Lind & Ponack

[57] ABSTRACT

A zinc-plated steel sheet with an ageing resistance is produced from an Al-killed steel by hot dip type, continuous zinc plating including recrystallization and annealing, where after recrystallization and grain growth, the steel sheet is quenched at a cooling rate of 30°~250° C/sec from 720°~600° C. to 310°~200° C.; after keeping the steel sheet at the same temperature for 0 to 15 seconds, the steel sheet is reheated to a molten zinc bath temperature; then the steel sheet is dipped into the molten zinc bath for zinc-plating; and then the steel sheet is cooled at a cooling rate of 250 to 5° C./sec from that temperature to 350° C.; and then the steel sheet is cooled at a specific average cooling rate in a temperature region of 350° C. to 300° C. and at a specific average cooling rate in a temperature region of from 300° C. to 285°~220° C.

9 Claims, 6 Drawing Sheets

PROCESS FOR PRODUCING A ZINC-PLATED STEEL SHEET WITH AN AGEING RESISTANCE BY HOT DIP-TYPE, CONTINUOUS ZINC PLATING

BACKGROUND OF THE INVENTION

1. Technical Field

This invention relates to a process for producing a zinc-plated steel sheet with an ageing resistance by hot dip-type, continuous zinc plating of an Al-killed steel, and more particularly to a process for producing a continuous zinc-plated steel sheet with an ageing resistance from an Al-killed steel by use of a special heat cycle in the course of quenching after the recrystallization and annealing and overageing after the dipping in a zinc plating bath.

2. Description of the Prior Art

Conventional processes for producing a zinc-plated steel sheet with an ageing resistance by hot dip-type, continuous zinc plating include a process by hot dip type, continuous zinc-plating of IF steel (Interstitial Free Steel) as a starting material and a process based on hot dip-type, continuous zinc-plating of Al-killed steel as a starting material, followed by post box annealing.

The former process by hot dip-type, continuous zinc-plating of IF steel as a starting material uses IF steel, that is, an extremely low carbon steel containing Ti, Nb, etc. as alloy elements, for the non-ageing purpose and has such a disadvantage as a high production cost for making the carbon content extremely low and adding alloy elements such as Ti, Nb, etc. to the steel. On the other hand, the latter process using an Al-killed steel as a starting material requires the post box annealing after the step of hot dip-type, continuous zinc plating, that is, one more step is required, resulting in such a serious drawback as an excessive production cost. Thus, it has been keenly desired to develop a process for producing a zinc-plated steel sheet with an ageing Incidentally, several attempts have been so far made regarding a process for producing a cold rolled steel sheet with a good ageing resistance by continuous annealing from an Al-killed steel as a starting material, in which the Al-killed steel is not further subjected to hot dip-type, continuous zinc plating. For example, it has been proposed to improve the ageing resistance by devising a heat cycle for operations from quenching down to overageing by the following prior arts: Japanese Patent Publication No. 58-10447 disclosing a horizontal overageing process, in which the steel sheet reheated after the supercooling is retained at the same temperature in an operation after the reheating and a relationship between the temperature and time in such an operation of retaining for overageing is composed of a horizontal linear line; and the Japanese Patent Publication No. 58-39890 and Japanese Patent Application Kokai (Laid-Open) Nos. 60-52527 and 61-276935 disclosing an overageing process according to an inclinatory cooling, in which the temperature of the steel sheet reheated after the super-cooling is changed with the passage of time in an operation after the reheating or the subsequent retaining and a relationship between the temperature and time in such an operation of cooling for overageing is expressed by an inclinatory line. However, the proposed processes, in which the steel sheet is not further subjected to hot dip-type, continuous plating, also fail to produce a cold rolled steel sheet having a good ageing resistance from an Al-killed steel, because the heat cycle concept as well as the heat cycle itself has defects.

SUMMARY OF THE INVENTION

The process for producing a zinc-plated steel sheet with an ageing resistance from an Al-killed steel as a starting material has remarkable industrial significances such as economical effects, etc. due to starting material cost and omission of process steps.

The present inventors have made extensive researches and tests to develop a process for producing a zinc-plated steel sheet with an ageing resistance from an Al-killed steel as a starting steel on the basis of a process for producing a cold rolled steel sheet with a distinguished ageing resistance by continuous annealing proposed by the present inventors earlier (Japanese Patent Publication No. 58-10447), and have made detailed investgations of cooling after the recrystallization and annealing and cooling and overageing treatment after the dipping in the zinc bath. As a result, the present inventors have found a novel process for producing a zinc-plated steel sheet with an ageing resistance from an Al-killed steel as a starting material for the first time.

An object of the present invention is to find heat cycles capable of producing a zinc-plated steel sheet with a distinguished ageing resistance from an Al-killed steel as a starting material in the thermal history of cooling after the recrystallization and annealing and cooling and overageing treatment after the dipping in the zinc bath.

As a result of extensive researches and tests to develop a process for producing a zinc-plated steel sheet with an ageing resistance from an Al-killed steel as a starting steel and detailed investigations of the cooling after the recrystallization and annealing and cooling and overageing treatment after the dipping in the zinc bath, the present inventors have found a novel process for producing a zinc-plated steel sheet with an ageing resistance from an Al-killed steel as a starting material.

The present invention provides a process for producing a zinc-plated steel sheet with an ageing resistance from a cold rolled steel sheet by hot dip type, continuous annealing, which comprises subjecting a cold rolled steel sheet essentially consisting of 0.010 to 0.10% by weight of C, 0.05 to 0.7% by weight of Mn, 0.002 to 0.035% by weight of S, less than 0.15% by weight of P, 0.01 to 0.10% by weight of soluble Al, 0.0010 to 0.0070% by weight of N, and the balance being iron and inevitable impurities to recrystallization and grain growth, quenching the steel sheet from 720°~600° C. to a quenching end temperature ($T_E$) of 310°~200° C. at a cooling rate ($\alpha$) of 30°~250° C./sec, keeping the steel constant at that temperature for 0~15 seconds, then reheating the steel sheet to a molten zinc bath temperature, dipping the steel sheet into the molten zinc bath, thereby zinc-plating the steel sheet, cooling the steel sheet from that temperature to 350° C. at a cooling rate of 250°~5° C./sec, cooling the steel sheet at an average cooling rate, $C.R_2$, defined by the following formula (1) in a temperature region of from 350° C., preferably below 350° C., to 300° C. and then cooling the steel sheet at an average cooling rate, $C.R_3$, defined by the following formula (2) in a temperature region of from 300° C., preferably below 300° C., to 285°~220° C.:

$$C.R_{2S} \leqq C.R_2 \leqq C.R_{2h} \quad (1)$$

$$C.R_{3S} \leqq C.R_3 \leqq C.R_{3h} \quad (2),$$

where $$C.R_{2S}=(-2.983\times(1/\alpha)+0.168)\times \exp(-0.0130\times T_E+5.18)$$

$$C.R_{2h}=(-4.185\times(1/\alpha)+0.263)\times \exp(-0.0130\times T_E+6.06)$$

$$C.R_{3S}=(-0.695\times(1/\alpha)+0.0392)\times \exp(-0.0130\times T_E+5.18)$$

$$C.R_{3h}=(-1.313\times(1/\alpha)+0.0741)\times \exp(-0.0130\times T_E+6.06)$$

cooling rate of quenching before supercooling (° C./sec)

$T_E$: quenching end temperature (° C.), where 220° C. is made to be the lowest temperature even if it is lower than 220° C.

$C.R_{2S}$: minimum average cooling rate in a temperature region of from 350° C., preferably below 350° C., to 300° C. (° C./sec)

$C.R_{2h}$: maximum average cooling rate in a temperature region of from 350° C., preferably below 350° C., to 300° C. (° C./sec)

$C.R_{3S}$: mimimum average cooling rate in a temperature region of from not higher than 300° C., preferably below 300° C., to 285°~220° C.

$C.R_{3h}$: maximum average cooling rate in a temperature region of from not higher than 300° C., preferably below 300° C. to 285°~220° C. (° C./sec).

The foregoing process can include an alloying treatment. That is, the present invention further provides a process for producing a zinc-plated steel sheet with an ageing resistance by hot dip type, continuous zinc plating, wherein after the dipping in the molten zinc bath, the steel sheet is reheated to 500°~600° C. for 5~20 seconds, thereby conducting an alloying treatment, then cooled to 350° C. at a cooling rate of 250°~5° C./sec and then subjected to a two-stage-inclinatory cooling at cooling rates 0.7 times as high as the average cooling rates $C.R_2$ and $C.R_3$ defined by the formulae (1) and (2), i.e. $0.7\times C.R_2$ and $0.7\times C.R_3$ in the temperature regions of from 350° C., preferably below 350° C., to 300° C. and from 300° C., preferably below 300° C., to 285°~220° C., respectively.

In that case, a cold rolled steel sheet containing 0.5~2.0 of B in terms of B/N can be used in each of the foregoing processes, whereby a hot dip-type, continuously zinc-plated steel sheet with a good workability coiling can be obtained.

According to another embodiment of the present invention, in each of the foregoing processes, the zinc-plated steel sheet having an ageing resistance can be produced in two discrete lines comprising a first line of quenching the steel sheet from 720°~600° C. to 310° or lower at a cooling rate ($\alpha$) of 30°~250° C./sec after the recrystallization and grain growth and coiling the steel sheet at a temperature of from room temperature to 150° C., preferably at a temperature near room temperature, and a second line starting from the successive reheating and dipping into the molten zinc bath.

DETAILED DESCRIPTION OF THE INVENTION

Figure 1:
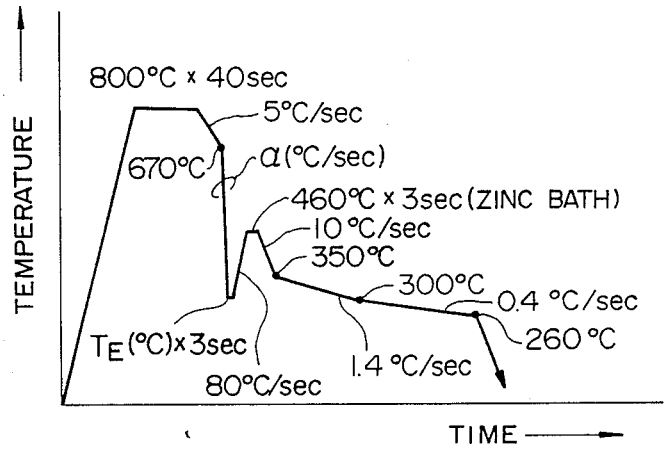
FIG. 1 is a heat cycle diagram used in tests for determining the conditions for cooling rate ($\alpha$) of quenching before supercooling and quenching end temperature according to the present invention.

At first, components and composition of the starting material will be described below.

It is known that the ductility and deep drawing property can be improved by decreasing the C content, whereas the ageing resistance will be deteriorated when the C content is too low. In the present invention, a cold rolled steel sheet with good workability and ageing resistance can be obtained in a range of 0.010 to 0.10% by weight of C.

Control of Mn and S contents is important in the present invention. In the present invention, MnS is utilized as preferential precipitation sites for carbide and thus more than some precipitation density is required. Below 0.05% by weight of Mn or below 0.002% by weight of S, a necessary precipitation density for cementite cannot be obtained and the ageing resistance will be deteriorated. Thus, the lower limits are 0.05% by weight of Mn and 0.002% by weight of S. Mn is a solid solution-intensifying element, and above 0.7% by weight of Mn, the workability is considerably deteriorated. Also above 0.035% by weight of S, the workability is considerably deteriorated. Thus, the upper limits are 0.7% by weight of Mn and 0.035% by weight of S.

P is an element having no significant influence upon the ageing resistance, but its upper limit must be 0.15% by weight in case of producing a cold rolled steel sheet for automobiles, because the spot weldability is considerably deteriorated above 0.15% by weight of P.

Soluble Al is a necessary element for controlling the amounts of oxygen and nitrogen in steel. When there is too much, steel will be hardened, and thus its upper limit is 0.10% by weight. When there is too little on the other hand, the ageing with nitrogen cannot be suppressed any more and thus its lower limit is 0.01% by weight.

N combines with soluble Al in steel to form AlN (or BN when B is contained) and harden the material. Thus, its upper limit is 0.0070% by weight. Its lower limit is 0.0010% by weight, because it is difficult to make the N content lower than 0.0010% by weight even by the current steel making technology.

B can be added to steel as a useful element when the deep drawing property is not required so much and when a soft, zinc-plated steel sheet having an ageing resistance is produced. In order to obtain a softness in an Al-killed steel, a high temperature coiling is required, but there are problems of thicker scales and deterioration in the pickling property due to the high temperature coiling. By addition of B to the steel, a soft steel can be obtained even at a low temperature coiling, for example, at coiling at about 600° C., and the problem of high temperature coiling of Al killed steel can be solved. In the present invention, B can be added to the steel as a useful element when the deep drawing property is not required so much and a soft, zinc-plated steel sheet having an ageing resistance is produced. When 0.5 or more of B is added thereto in terms of B/N, B combines with N in the steel to form BN and prevent the ageing with nitrogen. And a zinc-plated steel sheet with an ageing resistance, which is soft enough to undergo a low temperature coiling at about 600° C., can be produced. Above 2.0 of B in terms of B/N, the proportion of solid solution B is increased to harden the material. Thus, the B content is limited to 0.5~2.0 in terms of B/N.

Steps from casting to hot rolling can be carried out by cooling a slab and reheating it or by continuous casting and the subsequent direct rolling (CC-DR). A high slab heating temperature can be employed, but a low slab heating temperature, for example 1,000°~1,130° C., and a cold rolled steel sheet with a distinguished ageing resistance can be obtained. The coiling temperature after the hot rolling has no significant influence upon the ageing resistance and the satisfactory effects of the present invention can be obtained also at low temperature coiling of about 600° C., but the crystal grain size after the cold rolling and annealing can be increased at a high temperature coiling of 700° C. or higher and the workability can be also improved. Thus, the high temperature coiling is preferable.

A hot dip-type, continuous zinc plating process will be described below.

A step of heating a cold rolled steel sheet for recrystallization and grain growth can be carried out in the ordinary way and is not particularly limited. That is, it can be carried out by heating the steel sheet to a temperature higher than the recrystallization temperature and keeping it at a uniform temperature, thereby obtaining a sheet surface state with a good adhesion property of plating.

Steps of from cooling after the uniform heating to overageing treatment via dipping in a zinc bath are most important in the present invention, and are divided into two areas, i.e. (1) a thermal history of from cooling after the uniform heating to dipping in the zinc bath and (2) a thermal history of from cooling after the dipping in the zinc bath to overageing treatment.

The first area, i.e. (1) thermal history of from cooling after the uniform heating to dipping in the zinc bath, will be described below.

Quenching after the uniform heating must be carried out from 720°~600° C. to 310° C. or lower at a cooling rate of 30°~250° C./sec.

Cooling rate has a great influence upon the ageing resistance and is important for obtaining the ageing resistance and also necessary for obtaining a degree of supersaturation for higher solid solution C before overageing as a basis for a high density precipitation of cementite indispensable for shortening the overageing treatment time following the dipping in the zinc bath.

Its effect will be described according to the investigations made by the present inventors.

A cold rolled steel strip, produced according to production conditions of steel I shown in Table 2 and cold rolled, was subjected to an ageing resistance test by changing the cooling rate ($\alpha$), while setting $T_E$=240° C. constant in the heat cycle shown in FIG. 1. The results are shown in FIG. 2.

Figure 2:
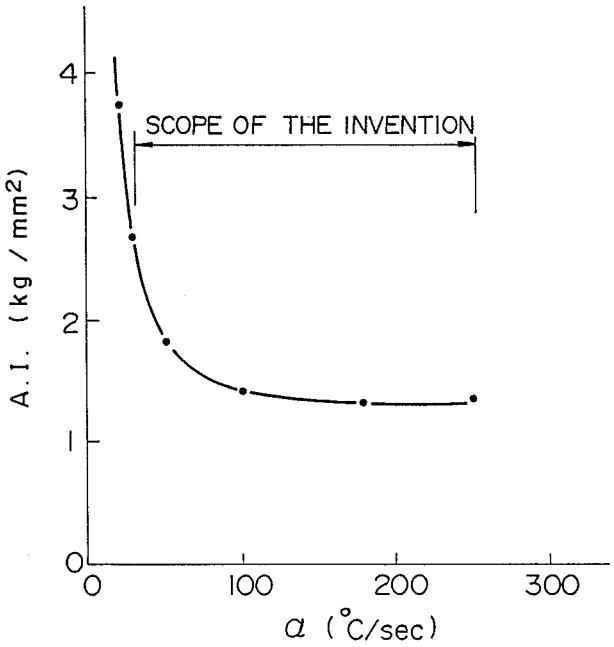
FIG. 2 is a diagram showing a relationship between the cooling rate ($\alpha$) of quenching before the supercooling and the ageing resistance (Ageing Index).

As shown in FIG. 2, the cooling rate ($\alpha$) has a great influence upon the ageing resistance (Ageing Index). In order to produce a zinc-plated steel sheet with a distinguished ageing resistance, the cooling rate ($\alpha$) must be 30° C./sec or higher, preferably 50° C./sec or higher. The reason why the upper limit is 250° C./sec is that the temperature distribution during the quenching is deteriorated above 250° C./sec, and the shape of the steel strip is also deteriorated due to the thermal strain in the steel sheet.

Quenching end temperature will be described in detail below.

The quenching end temperature is an important temperature that determines the precipitation density of cementite, and has a significant influence upon the ageing resistance. Furthermore, the quenching end temperature is also an important temperature for determining a a heat cycle of optimum overageing according to the inclinatory cooling after the dipping in the zinc bath, i.e. an essential condition for producing a zinc-plated steel sheet with a distinguished ageing resistance by carrying out an overageing for a short time.

This effect will be described according to the investigations made by the present inventors.

A cold rolled steel strip, produced according to production conditions of steel I shown in Table 2 and cold rolled, was subjected to an ageing resistance property test by changing the quenching end temperature ($T_E$) while setting $\alpha$=100° C./sec constant in the heat cycle shown in FIG. 1. The results are shown in FIG. 3.

Figure 3:
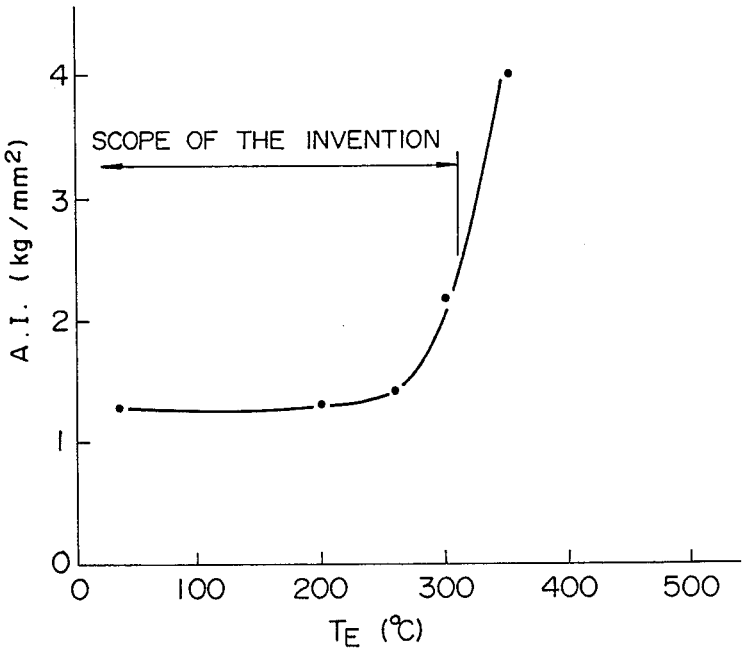
FIG. 3 is a diagram showing a relationship between the quenching end temperature ($T_E$) and the ageing resistance (Ageing Index).

As shown in FIG. 3, the quenching end temperature ($T_E$) has a significant influence upon the ageing resistance (Ageing Index). In order to produce a cold rolled steel sheet with a distinguished ageing resistance, the quenching end temperature ($T_E$) must be 310° C. or lower, preferably 300° C. or lower. With a decrease in the quenching end temperature ($T_E$), the ageing resistance is improved, and no remarkable deterioration of the material appears even by quenching down to room temperature. Thus, the lower limit of the quenching end temperature ($T_E$) is not limited from the viewpoint of metallurgy, but when the recrystallization and annealing and the dipping in the zinc bath are carried out in one line, as described before, the effect upon the improvement of ageing resistance is saturated if the quenching end temperature ($T_E$) is lower than 200° C., and the energy loss in the reheating is increased. Thus, the lower limit of the quenching end temperature ($T_E$) is limited to 200° C. in this case. When the recrystallization and annealing and the dipping in the zinc bath are carried out in two discrete lines owing to a production facility restriction, as described before, a zinc-plated steel sheet with a distinguished ageing resistance can be produced from an Al-killed steel as a desired starting material of the present process, even if the quenching end temperature is room temperature. Thus, the lower limit of the quenching end temperature is not limited to 200° C. in this case.

The time for keeping the steel sheet constant at the quenching end temperature will be described below.

Even if no time is given for keeping the steel sheet constant at the quenching end temperature, cementite precipitation nuclei can be readily formed in the course of reheating. It may be possible to keep the steel sheet constant around the quenching end temperature or cool the steel sheet in the oven, depending upon the production facility. The necessary and sufficient time for keeping the steel sheet constant at the quenching end temperature as far as the reheating facility is concerned is a maximum of 15 seconds, even if a given production facility is taken into account. If the time for keeping the steel sheet constant at the quenching end temperature exceeds 15 seconds, it makes the size of the production facility unnecessarily longer, increasing the production facility cost. Thus, the upper limit of the time for keeping the steel sheet constant at the quenching end temperature is 15 seconds.

The time for transferring from the first line to the second line when a zinc-plated steel sheet is produced in two discrete lines, as described before, has been also investigated and it has been found that there is no specific limit to the time for the transference.

Reheating rate in reheating up to approximately the zinc bath temperature will be described below.

The reheating rate has no influence upon the ageing resistance and thus is not particularly restricted. A heating system, based on a radiant tube with a reheating rate such as 10° C./sec or induction heating or direct electric heating with a reheating rate such as 100° C./sec, or based on use of these two means at the same time, can be thus used. The rapid heating system based on the induction heating, etc., is distinguished as a reheating means, because the reheating rate is higher and the reheating time can be shortened with better controllability of the steel sheet temperature.

The zinc bath temperature can be a temperature usually used in the hot dip type, continuous zinc plating, for example, 450° C. to 500° C., and is not particularly limited. The lower limit of the zinc bath temperature is not lower than the melting temperature of zinc and the upper limit thereof is usually about 500° C. because if it is too high, zinc is oxided and the energy loss becomes large. The zinc bath usually contains zinc as a main component and, if necessary, 0.5% or less of aluminum.

The second area, that is, (2) the thermal history of the cooling after the dipping in the zinc bath and the overageing treatment, will be described below.

The present inventors have studied various conditions for the inclinatory cooling after the dipping in the zinc bath and have found that the conditions for the inclinatory cooling must be determined in view of the following facts, i.e. (1) the inclinatory cooling can be divided into three stages of temperature, in each of which an optimum cooling rate exists and (2) the cooling rate in each of the three stages of temperature greatly depends upon the cooling rate ($\alpha$) of quenching before supercooling and the quenching end temperature ($T_E$).

At first, cooling after the dipping in the zinc bath without the alloying treatment will be described below.

The inclinatory cooling after the dipping in the zinc bath to 350° C. can be carried out at a cooling rate of 250°~5° C./sec and there is no strict limitation. The reason why the upper limit to the cooling rate is 250° C./sec is that if the cooling rate is above 250° C./sec, no uniform temperature distribution can be obtained and the shape of the steel sheet is deteriorated. The reason why the lower limit is 5° C./sec is that if the cooling rate is below 5° C./sec, it takes much time in cooling, resulting in a failure to meet the necessary steel sheet temperature limit (380° C. or lower) at a top roll which is situated above the zinc bath for preventing the pickup of zinc onto hearth rolls which follow the top roll.

The condition for the inclinatory cooling in the temperature region of below 350° C. will be described below.

It is an important point of the present invention how to set the condition for the inclinatory cooling in this temperature region of below 350° C. The present inventors have made extensive tests and have found that the rate of decreasing the solid solution carbon during the inclinatory cooling in the temperature region of below 350° C. greatly depends upon the density of cementite to be precipitated and the precipitation density of cementite greatly depends upon the quenching end temperature ($T_E$) and the cooling rate ($\alpha$) of quenching before the supercooling, and have succeeded in obtaining a quantitative relationship thereof.

Its effect will be described below according to the investigations made by the present inventors.

Figure 4:
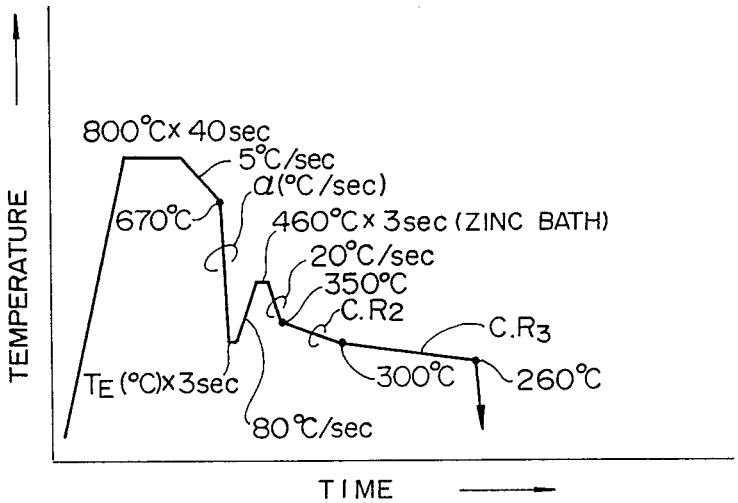
FIG. 4 is a heat cycle diagram used in tests for determining conditions for inclinatory cooling after the dipping in a zinc bath.

A cold rolled steel strip, prepared according to production conditions of steel I shown in Table 2 and cold rolled, was subjected to tests to investigate the influence of average cooling rate ($C.R_2$) in a temperature region of from 350° C. to 300° C. and average cooling rate ($C.R_3$) in a temperature region of from 300° C. to 260° C. upon the ageing resistance, by changing the condition for overageing treatment after the dipping in the zinc bath as shown in Table 1 in the heat cycle of FIG. 4. The results are shown in Table 1.

TABLE 1

| | Production conditions | | | | | Ageing resistance | Remarks | | |
|---|---|---|---|---|---|---|---|---|---|
| | | | | | | | Region of the Invention | | |
| Steel | $\alpha$ °C./sec | $T_E$ °C. | $C.R_2$ °C./sec | $C.R_3$ °C./sec | Temper rolling ratio % | A.I. kg/mm$^2$ | $C.R_2$ (°C./sec) | $C.R_3$ (°C./sec) | |
| Steel 1 | 100 | 260 | 1.6 | 1.6 | 1.0 | 2.8 | 0.8~3.2 | 0.2~0.9 | Comparative |
| Steel 2 | 100 | 260 | 1.6 | 0.5 | 1.0 | 1.4 | 0.8~3.2 | 0.2~0.9 | The Invention |
| Steel 3 | 100 | 290 | 1.2 | 1.2 | 1.0 | 3.3 | 0.6~2.2 | 0.1~0.6 | Comparative |
| Steel 4 | 100 | 290 | 1.2 | 0.3 | 1.0 | 1.7 | 0.6~2.2 | 0.1~0.6 | The Invention |
| Steel 5 | 200 | 230 | 2.0 | 0.7 | 1.0 | 1.3 | 1.4~5.2 | 0.3~1.4 | The Invention |
| Steel 6 | 50 | 310 | 2.0 | 0.7 | 1.0 | 3.6 | 0.3~1.4 | 0.1~0.4 | Comparative |

Steels 1 and 3 are comparative examples, which were subjected not to two-stage, inclinatory cooling, but to linear inclinatory cooling at 1.6° C./sec and 1.2° C./sec for both $C.R_2$ and $C.R_3$, respectively, and their ageing resistance is considerably worse than that of steels 2 and 4 according to the present process.

Steels 5 and 6 are examples, which were subjected to two-stage, inclinatory cooling both at 2.0° C./sec for $C.R_2$ and 0.7° C./sec for $C.R_3$. Steel 6 is a comparative example which is beyond the upper limits of $C.R_2$ and $C.R_3$ of the present process and its ageing resistance is considerably worse than that of steel 5 according to the present process where the two-stage inclinatory cooling was carried out at $C.R_2$ and $C.R_3$ within the region of the present process.

As described in detail in the foregoing investigation results, the conditions for the inclinatory cooling after the dipping in the zinc bath to produce a zinc-plated steel sheet with a distinguished ageing resistance from an Al-killed steel can be summarized as follows:

Cooling in the temperature region of 350° C. or higher is not particularly limited; cooling in the temperature region of from 350° C. to 300° C. must be carried out at an average cooling rate ($C.R_2$) defined by the following formula (1); and cooling in the temperature region of below 300° C. must be carried out to 285°~220° C. (end temperature of the inclinatory cooling) at an average cooling rate ($C.R_3$) defined by the following formula (2):

$$C.R_{2S} \leqq C.R_2 \leqq C.R_{2h} \quad (1)$$

$$C.R_{3S} \leqq C.R_3 \leqq C.R_{3h} \quad (2)$$

The end temperature of the inclinatory cooling will be described below.

The end temperature of the inclinatory cooling must be selected in view of a desired characteristic value of ageing resistance. In order to produce a zinc-plated steel sheet having an ageing resistance expressed by an ageing index (A.I.) of, for example, not more than 3 kg/mm$^2$, cooling must be carried out to about 280° C. In order to produce a zinc-plated steel sheet having a higher ageing resistance expressed by an A.I. of, for example, not more than 2 kg/mm$^2$, cooling must be carried out to about 260° C. It is needless to say that the ageing resistance can be somewhat improved with further cooling, but the improving efficiency of ageing resistance is not so remarkable in spite of the increased time for overageing treatment. Thus, the lower limit of the end temperature of the inclinatory cooling is 220° C. and the upper limit is 285° C.

Cooling after the end of inclinatory cooling for overageing can be a slow cooling to 200° C. or lower by gas jet, etc. and then a quenching to produce a better steel sheet shape, or can be a quenching from the end temperature of the inclinatory cooling if there is no need for the production of a better steel sheet shape.

Thermal history after the dipping in the zinc bath in case of an alloying treatment will be described below.

Heat treatment for the alloying treatment is carried out under the ordinary conditions, that is, by heating the steel sheet to 500°~600° C. for 5~20 seconds, thereby carrying out the alloying treatment and then cooling the steel sheet to 350° C. at a cooling rate of 5°~250° C./sec. The conditions for the cooling to 350° C. are not particularly limited. When the temperature for the alloying treatment is lower than 500° C. or the treatment time is less than 5 seconds, satisfactory alloying cannot proceed, whereas, when the temperature for the alloying treatment is over 600° C. or the treatment time is over 20 seconds, the alloying proceeds excessively and no good plating layer can be obtained any more. The cooling to 350° C. after the alloying treatment is carried out under the same condition as that without any alloying treatment, that is, cooling to 350° C. at a cooling rate of 5°~250° C./sec.

Cooling from below 350° C. is most important for producing a zinc-plated steel sheet having an ageing resistance. The present inventors have made extensive tests in comparison with the case without any alloying treatment and have found that an alloying-treated, zinc-plated steel sheet having a distinguished ageing resistance can be obtained by carrying out two-stage, inclinatory cooling for the cooling from below 350° C. at cooling rates 0.7 times as high as the average cooling rates ($C.R_2$ and $C.R_3$), defined by the formulae (1) and (2) in case of no alloying treatment, i.e. $0.7 \times C.R_2$ and $0.7 \times C.R_3$, respectively. That is, the conditions for the cooling from below 350° C. are that in the temperature region of from below 350° C. to 300° C., the average cooling rate is 0.7 times as high as the average cooling rate ($C.R_2$) defined by the formula (1) in case of no alloying treatment, i.e. $0.7 \times C.R_2$; and in the temperature region of from below 300° C. to 285°~220° C., the average cooling rate is 0.7 times as high as the average cooling rate ($C.R_3$) defined by the formula (2) in case of no alloying treatment, i.e. $0.7 \times C.R_3$.

A correction factor (k) for the average cooling rates ($C.R_2$ and $C.R_3$) in case of the alloying treatment will be described below according to the investigations made by the present inventors.

Figure 5:
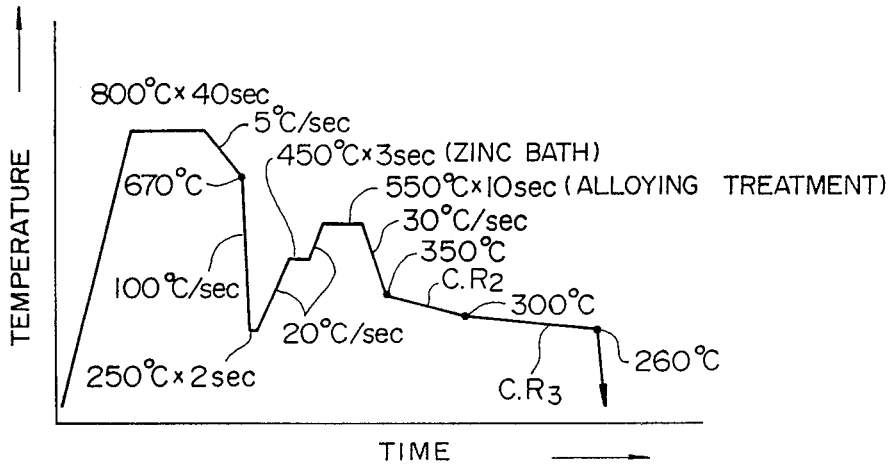
FIG. 5 is a heat cycle diagram used in tests for determining conditions for inclinatory cooling [correction factors (k) for $C.R_2$ and $C.R_3$] after the alloying treatment in the case that the alloying treatment is carried out.
Figure 6:
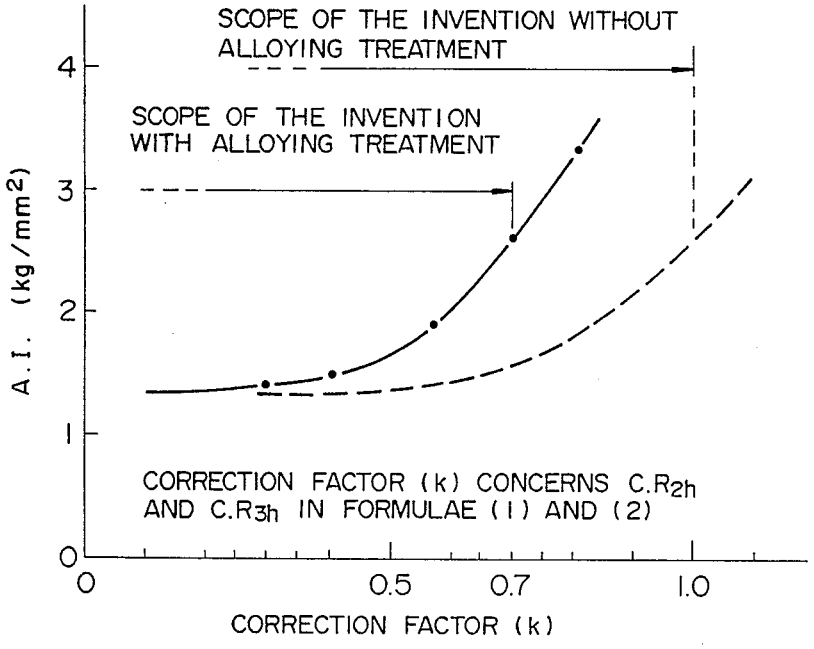
FIG. 6 is a diagram showing a relationship between the conditions for inclinatory cooling [correction factors (k) for $C.R_2$ and $C.R_3$] after the alloying treatment and the ageing resistance (Ageing Index) in case that the alloying treatment was carried out.

A cold rolled steel strip, produced according to production conditions of steel I shown in Table 2 and cold rolled, was treated in the heat cycle shown in FIG. 5: the steel strip was reheated after the dipping in the zinc bath, subjected to the alloying treatment and cooled to 350° C.; and then influences upon the ageing resistance property was investigated by changing $C.R_2$ and $C.R_3$ of FIG. 5 to various degrees. The result thus obtained is shown in FIG. 6. As shown in FIG. 6, it has been found that the conditions for the cooling in the temperature regions of below 350° C. must be corrected with a correction factor (k=0.7) in each case that the alloying treatment is carried out. That is, the average cooling rates in case of alloying treatment must be 0.7 times as high as the average cooling rates ($C.R_2$ and $C.R_3$) defined by the formulae (1) and (2) in the case of no alloying treatment, respectively, i.e. $0.7 \times C.R_2$ and $0.7 \times C.R_3$, and the upper limits ($C.R_{2h}$ and $C.R_{3h}$) of the average cooling rates ($C.R_2$ and $C.R_3$) in the respective temperature regions (from below 350° C. to 300° C. and from below 300° C. to 285°~220° C.) must be also corrected with the correction factor (k=0.7) for each.

In FIG. 6, relationships between the ageing resistance (Ageing Index) and the correction factor (k) to the upper limits ($C.R_{2h}$ and $C.R_{3h}$) of the average cooling rates ($C.R_2$ and $C.R_3$) in the respective temperature regions are shown. As shown in FIG. 6, in order to assure that the level of A.I. at the boundary of the scope of the present invention in case of alloying treatment is equal to that in case of no alloying treatment, the size of the boundary of the scope of the present invention in case of alloying treatment must be 0.7 time the size of that in case of no alloying treatment.

It is apparent from FIG. 6 that zinc-plated steel sheets with a distinguished ageing resistance can be produced when the correction factor (k) for obtaining the average cooling rates ($C.R_2$ and $C.R_3$) in the respective temperature regions in case of the alloying treatment is 0.7. That is, the average cooling rates ($C.R_2$ and $C.R_3$) in the respective temperature regions (from below 350° C. to 300° C. and from below 300° C. to 285°~220° C.) in case of the alloying treatment are 0.7 times as high as those in case of no alloying treatment, respectively. The reason why the correction factor (k) is 0.7 has been investigated and it seems to be due to the fact that the precipitation density of cementite is decreased during the alloying treatment at 500°~600° C.

As described in detail above, the present invention provides a process for producing a zinc-plated, steel sheet with a distinguished ageing resistance property by hot dip-type, continuous zinc plating and has a significant economical effect.

PREFERRED EMBODIMENTS OF THE INVENTION

The effects of the present invention will be described below, referring to Examples.

Examples

Hot rolled steel strips prepared under the manufacturing conditions shown in Table 2 were cold rolled to a thickness of 0.8 mm at a draft of 80% and subjected to hot dip-type, continuous zinc plating in heat cycles shown in FIG. 7 (A), (B), (C), (D), (E) and (F) and further subjected to 1.0% temper rolling to investigate mechanical properties. The results of investigation of mechanical properties are shown in Table 3 together with those of the steel sheets prepared according to the conventional process.

Figure 7A:
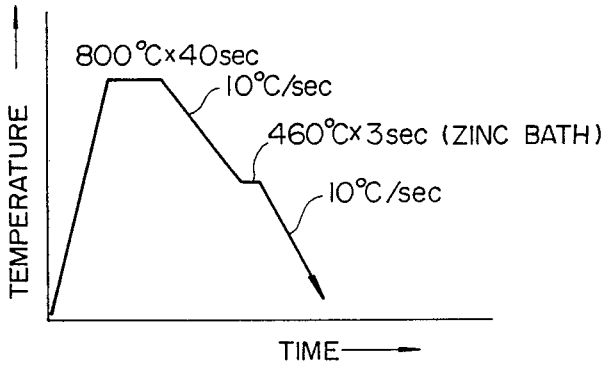
FIG. 7 (A)~(F) are heat cycle diagrams of hot dip-type, continuous zinc plating according to examples, respectively.
Figure 7B:
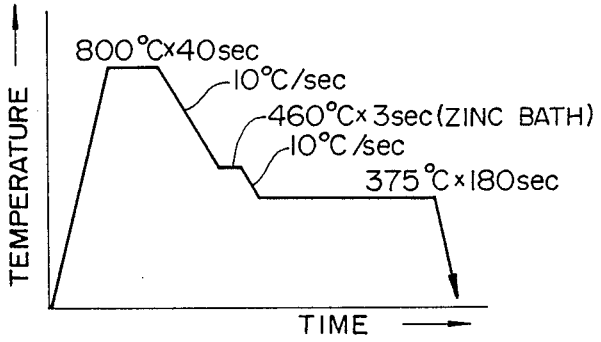
Figure 7C:
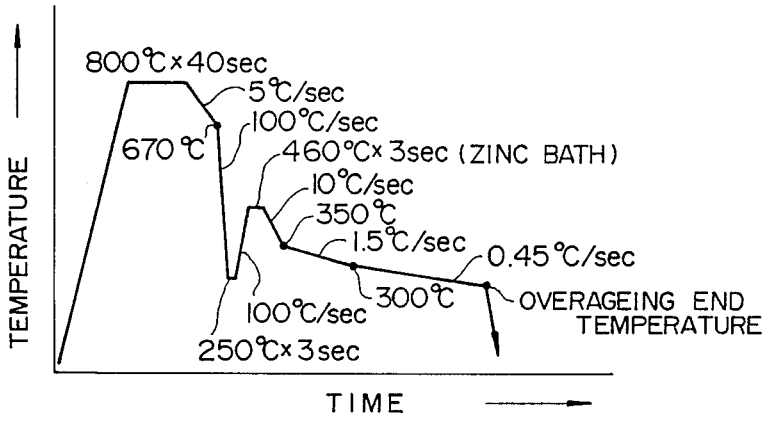
Figure 7D:
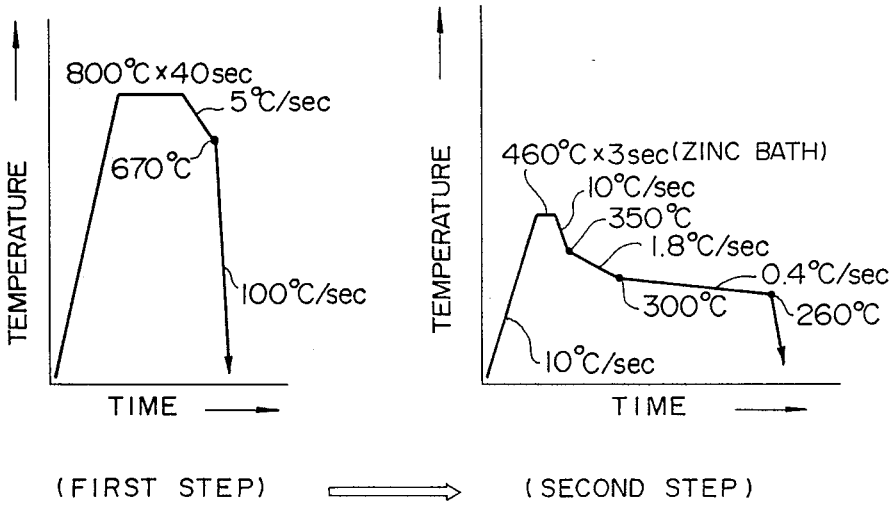
Figure 7E:
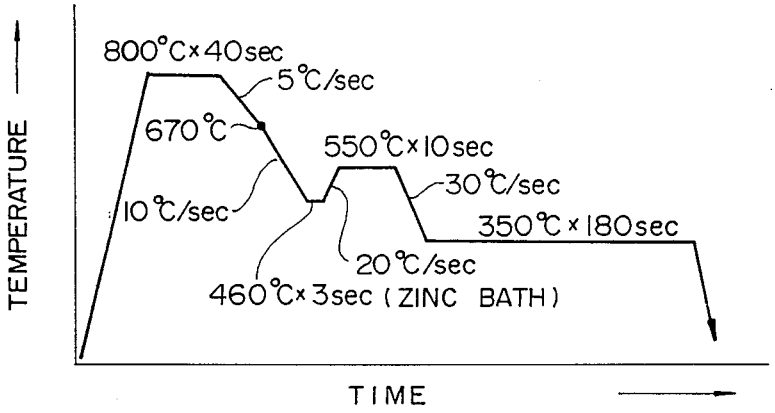
Figure 7F:
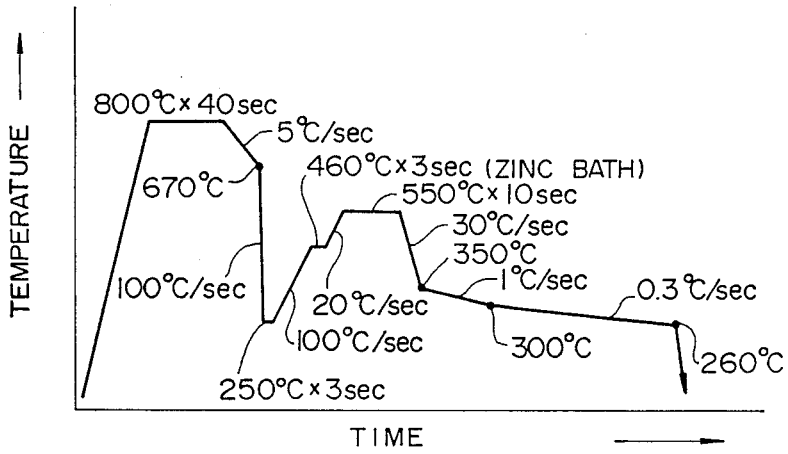

FIG. 7(E) and (F) are the heat cycles according to the embodiments of hot dip-type, continuous zinc plating with the alloying treatment.

Conditions for the hot dip-type, zinc plating bath are as follows:

Zinc bath composition: Distilled zinc containing 0.1% by weight of Al

Bath temperature: 460° C.

Dipping time: 3 seconds

Starting steels I, II and III are hot rolled steel strips prepared according to production conditions shown in Table 2, where steel I is a low carbon Al-killed steel for deep drawing, steel II is a low carbon Al-killed steel containing B for working and steel III is a low carbon Al-killed steel containing P for drawing working of 35-kg class, which means that the steel strip has a tensile strength of 35 kg/mm² or more.

TABLE 2

| Steel | Components (%) < Hot rolled sheet > | | | | | | | | Hot rolling conditions | | | |
|---|---|---|---|---|---|---|---|---|---|---|---|---|
| species | C | Si | Mn | P | S | sol.Al | N | B | Heating | Finishing | Coiling | Remarks |
| Steel I | 0.021 | 0.01 | 0.11 | 0.009 | 0.008 | 0.054 | 0.0038 | Tr | 1060 | 910 | 700 | The Invention |
| Steel II | 0.019 | 0.01 | 0.16 | 0.013 | 0.008 | 0.036 | 0.0018 | 0.0020 | 1100 | 910 | 635 | The Invention |
| Steel III | 0.030 | 0.01 | 0.22 | 0.073 | 0.012 | 0.044 | 0.0036 | Tr | 1150 | 880 | 710 | The Invention |

TABLE 3

| | Production condition | | Mechanical properties | | | | | |
|---|---|---|---|---|---|---|---|---|
| Ex. No. | Starting Steel | Heat cycle | Y.P kg/mm² | T.S. kg/mm² | El (%) | A.I. kg/mm² | γ value | Remarks |
| No. 1 | Steel I | A | 30.8 | 37.4 | 36.5 | 6.4 | 1.68 | Comparative |
| No. 2 | Steel I | B | 20.2 | 33.2 | 43.0 | 4.1 | 1.74 | Comparative |
| No. 3 | Steel I | C | 19.3 | 32.3 | 45.8 | 1.4 | 1.74 | The Invention |
| No. 4 | Steel I | D | 19.5 | 32.5 | 45.4 | 1.3 | 1.75 | The Invention |
| No. 5 | Steel II | A | 31.9 | 37.8 | 34.9 | 6.6 | 1.26 | Comparative |
| No. 6 | Steel II | B | 22.0 | 33.8 | 42.1 | 4.3 | 1.30 | Comparative |
| No. 7 | Steel II | C | 19.9 | 32.9 | 44.2 | 1.5 | 1.31 | The Invention |
| No. 8 | Steel II | D | 20.2 | 33.2 | 43.8 | 1.4 | 1.29 | The Invention |
| No. 9 | Steel III | A | 34.8 | 41.3 | 28.9 | 6.6 | 1.54 | Comparative |
| No. 10 | Steel III | B | 26.4 | 37.9 | 36.0 | 4.4 | 1.65 | Comparative |
| No. 11 | Steel III | C | 25.0 | 37.0 | 37.4 | 1.7 | 1.64 | The Invention |
| No. 12 | Steel III | D | 25.3 | 37.5 | 37.0 | 1.6 | 1.63 | The Invention |
| No. 13 | Steel I | — | 19.0 | 32.1 | 46.0 | 0.9 | 1.75 | Conventional |
| No. 14 | Steel I | E | 22.3 | 34.5 | 40.2 | 4.3 | 1.60 | Conventional |
| No. 15 | Steel I | F | 21.1 | 33.0 | 43.0 | 1.4 | 1.62 | The Invention |

Examples Nos. 1, 5 and 9 are comparative examples of conventional hot dip-type, continuous zinc plating without the overageing treatment and the treatment according to the heat cycle shown in FIG. 7 (A).

Examples Nos. 2, 6 and 10 are comparative examples of hot dip-type, continuous zinc plating with the overageing treatment, which has lately been put to practical use, and treatment according to the heat cycle shown in FIG. 7 (B).

Examples Nos. 3, 7 and 11 are examples of the present invention with the treatment in the heat cycle according to the present process shown in FIG. 7 (C).

Examples Nos. 4, 8 and 12 are examples of the present invention with the treatment in two discrete lines according to the present process shown in FIG. 7 (D).

In Table 3, the results of the conventional process (box annealing after the plating) are also shown.

Examples Nos. 3 and 4, 7 and 8, and 11 and 12 are directed to deep drawing, working and drawing working of 35-kg class, respectively and show that a distinguished ageing resistance can be obtained in all these examples and is practically equivalent to that of Example No. 13 directed to the conventional process. Thus, hot dip-type, continuous zinc-plated steel sheets with a distinguished ageing resistance can be produced, as apparent from these examples.

On the other hand, Examples Nos. 1, 2, 5, 6, 9 and 10 show that the resulting ageing resistance is considerably worse in all these examples. Examples Nos. 2, 6 and 10 are directed to hot dip-type, continuous zinc plating with the overageing treatment, which has lately been put to practical use, but show a poor ageing resistance, as compared with that of the steel sheets according to the present process. That is, hot dip-type, continuous zinc-plated steel sheets with a distinguished ageing resistance are not obtained in all these examples.

Example No. 14 is an example of the conventional hot dip-type, continuous zinc plating with the alloying treatment and the treatment according to the heat cycle shown in FIG. 7 (E).

Example No. 15 is an example of the present process, that is, hot dip-type, continuous zinc plating with the alloying treatment and the treatment according to the heat cycle shown in FIG. 7 (F) of the present process.

Example No. 15 of the present process shows that the A.I. is lower and an alloying-treated, continuous zinc-plated steel sheet having a distinguished ageing resistance can be produced, whereas Example No. 14 of the conventional process shows that the A.I. is higher and no continuous zinc-plated steel having an ageing resistance can be obtained.

As described in detail above, the present invention provides a process for producing a hot dip-type, continuous zinc-plated steel sheet from an Al-killed steel and has remarkable industrial significance, such as economical effects, etc. due to lower starting material costs and saving of process steps.

What is claimed is:

1. A process for producing a zinc-plated steel sheet with an ageing resistance from a cold rolled steel sheet by hot dip type, continuous zinc plating including steps of recrystallization and annealing, which comprises subjecting a cold rolled steel sheet essentially consisting of 0.010 to 0.10% by weight of C, 0.05 to 0.7% by weight of Mn, 0.002 to 0.035% by weight of S, less than 0.15% by weight of P, 0.01 to 0.10% by weight of soluble Al, 0.0010 to 0.0070% by weight of N, and the balance being iron and inevitable impurities to recrystallization and grain growth, quenching the steel sheet from 720°~600° C. to a quenching end temperature ($T_E$) of 310°~200° C. at a cooling rate ($\alpha$) of 30°~250° C./sec, keeping the steel constant at that temperature for 0~15 seconds, then reheating the steel sheet to a molten zinc bath temperature, dipping the steel sheet into the molten zinc bath, thereby zinc-plating the steel sheet, cooling the steel sheet from that temperature to 350° C. at a cooling rate of 250°~5° C./sec, cooling the steel sheet at an average cooling rate, $C.R_2$, defined by the following formula (1) in a temperature region of from below 350° C. to 300° C. and then cooling the steel sheet at an average cooling rate, $C.R_3$, defined by the following formula (2) in a temperature region of from below 300° C. to 285°~220° C.:

$$C.R_{2S} \leqq C.R_2 \leqq C.R_{2h} \quad (1)$$

$$C.R_{3S} \leqq C.R_3 \leqq C.R_{3h} \quad (2),$$

where $$C.R_{2S}=(-2.983\times(1/\alpha)+0.168)\times \exp(-0.0130\times T_E+5.18)$$

$$C.R_{2h}=(-4.185\times(1/\alpha)+0.263)\times \exp(-0.0130\times T_E+6.06)$$

$$C.R_{3S}=(-0.695\times(1/\alpha)+0.0392)\times \exp(-0.0130\times T_E+5.18)$$

$$C.R_{3h}=(-1.313\times(1/\alpha)+0.0741)\times \exp(-0.0130\times T_E+6.06)$$

$\alpha$: cooling rate of quenching before supercooling (° C./sec)

$T_E$: quenching end temperature (° C.), where 220° C. is made to be the lowest temperature even if it is lower than 220° C.

$C.R_{2S}$: minimum average cooling rate in a temperature region of from below 350° C. to 300° C. (° C./sec)

$C.R_{2h}$: maximum average cooling rate in a temperature region of from below 350° C. to 300° C. (°C./sec)

$C.R_{3S}$: minimum average cooling rate in a temperature region of from below 300° C. to 285°~220° C. (°C./sec)

$C.R_{3h}$: maximum average cooling rate in a temperature region of from below 300° C. to 285°~220° C. (°C./sec).

2. A process for producing a zinc-plated steel sheet with an ageing resistance from a cold rolled steel sheet by hot dip type, continuous zinc plating including steps of recrystallization and annealing, which comprises subjecting a cold rolled steel sheet essentially consisting of 0.010 to 0.10% by weight of C, 0.05 to 0.7% by weight of Mn, 0.002 to 0.035% by weight of S, less than 0.15% by weight of P, 0.01 to 0.10% by weight of soluble Al, 0.0010 to 0.0070% by weight of N, and the balance being iron and inevitable impurities to recrystallization and grain growth, quenching the steel sheet from 720°~600° C. to a quenching end temperature ($T_E$) of 310°~200° C. at a cooling rate ($\alpha$) of 30°~250° C./sec, keeping the steel constant at that temperature for 0~15 seconds, then reheating the steel sheet to a molten zinc bath temperature, dipping the steel sheet into the molten zinc bath, thereby zinc-plating the steel sheet, reheating the steel sheet to 500°~600° C. for 5~20 seconds, thereby conducting an alloying treatment, cooling the steel sheet to 350° at a cooling rate of 250°~5° C./sec, cooling the steel sheet at an average cooling rate of $0.7\times C.R_2$, where $C.R_2$ is defined by the following formula (1), in a temperature region of from below 350° C. to 300° C. and then cooling the steel sheet at an average cooling rate of $0.7\times C.R_3$, where $C.R_3$ is defined by the following formula (2), in a temperature region of from below 300° C. to 285°~220° C.:

$$C.R_{2S} \leqq C.R_2 \leqq C.R_{2h} \quad (1)$$

$$C.R_{3S} \leqq C.R_3 \leqq C.R_{3h} \quad (2),$$

where $$C.R_{2S} = (-2.983 \times (1/\alpha) + 0.168) \times \exp(-0.0130 \times T_E + 5.18)$$

$$C.R_{2h} = (-4.185 \times (1/\alpha) + 0.263) \times \exp(-0.0130 \times T_E + 6.06)$$

$$C.R_{3S} = (-0.695 \times (1/\alpha) + 0.0392) \times \exp(-0.0130 \times T_E + 5.18)$$

$$C.R_{3h} = (-1.313 \times (1/\alpha) + 0.0741) \times \exp(-0.0130 \times T_E + 6.06)$$

$\alpha$: cooling rate of quenching before supercooling (°C./sec)

$T_E$: quenching end temperature (°C.), where 200° C. is made to be the lowest temperature even if it is lower than 200° C.

$C.R_{2S}$: minimum average cooling rate in a temperature region of from below 350° C. to 300° C. (°C./sec)

$C.R_{2h}$: maximum average cooling rate in a temperature region of from below 350° C. to 300° C. (°C./sec)

$C.R_{3S}$: minimum average cooling rate in a temperature region of from below 300° C. to 285°~220° C. (°C./sec)

$C.R_{3h}$: maximum average cooling rate in a temperature region of from below 300° C. to 285°~220° C. (°C./sec).

3. A process for producing a zinc-plated steel sheet with an ageing resistance from a cold rolled steel sheet by hot dip type, continuous zinc plating including steps of recrystallization and annealing, which comprises subjecting a cold rolled steel sheet essentially consisting of 0.010 to 0.10% by weight of C, 0.05 to 0.7% by weight of Mn, 0.002 to 0.035% by weight of S, less than 0.15% by weight of P, 0.01 to 0.10% by weight of soluble Al, 0.0010 to 0.0070% by weight of N, and the balance being iron and inevitable impurities to recrystallization and grain growth, quenching the steel sheet from 720°~600° C. to a quenching end temperature ($T_E$) of 310° C. or lower at a cooling rate ($\alpha$) of 30°~250° C./sec, coiling the steel sheet at a temperature of from room temperature to 150° C., wherein said quenching after the recrystallization and grain growth, and said coiling constitute a first discrete line in the process, and said first discrete line is followed by a second discrete line, namely comprising reheating the steel sheet to a molten zinc bath temperature, dipping the steel sheet into the molten zinc bath, thereby zinc-plating the steel sheet, cooling the steel sheet from that temperature to 350° C. at a cooling rate of 250°~5° C./sec, cooling the steel sheet at an average cooling rate, $C.R_2$, defined by the following formula (1) in a temperature region of from below 350° C. to 300° C. and then cooling the steel sheet at an average cooling rate, $C.R_3$, defined by the following formula (2) in a temperature region of from below 300° C. to 285°~220° C.:

$$C.R_{2S} \leqq C.R_2 \leqq C.R_{2h} \quad (1)$$

$$C.R_{3S} \leqq C.R_3 \leqq C.R_{3h} \quad (2)$$

, where $$C.R_{2S} = (-2.983 \times (1/\alpha) + 0.168) \times \exp(-0.0130 \times T_E + 5.18)$$

$$C.R_{2h} = (-4.185 \times (1/\alpha) + 0.263) \times \exp(-0.0130 \times T_E + 6.06)$$

$$C.R_{3S} = (-0.695 \times (1/\alpha) + 0.0392) \times \exp(-0.0130 \times T_E + 5.18)$$

$$C.R_{3h} = (-1.313 \times (1/\alpha) + 0.0741) \times \exp(-0.0130 \times T_E + 6.06)$$

$\alpha$: cooling rate of quenching before supercooling (°C./sec)

$T_E$: quenching end temperature (°C.), where 200° C. is made to be the lowest temperature even if it is lower than 200° C.

$C.R_{2S}$: minimum average cooling rate in a temperature region of from below 350° C. to 300° C. (°C./sec)

$C.R_{2h}$: maximum average cooling rate in a temperature region of from below 350° C. to 300° C. (°C./sec)

$C.R_{3S}$: minimum average cooling rate in a temperature region of from below 300° C. to 285°~220° C. (°C./sec)

$C.R_{3h}$: maximum average cooling rate in a temperature region of from below 300° C. to 285°~220° C. (°C./sec).

4. A process for producing a zinc-plated steel sheet with an ageing resistance from a cold rolled steel sheet by hot dip type, continuous zinc plating including steps of recrystallization and annealing, which comprises subjecting a cold rolled steel sheet essentially consisting of 0.010 to 0.10% by weight of C, 0.05 to 0.7% by weight of Mn, 0.002 to 0.035% by weight of S, less than 0.15% by weight of P, 0.01 to 0.10% by weight of soluble Al, 0.0010 to 0.0070% by weight of N, and the balance being iron and inevitable impurities to recrystallization and grain growth, quenching the steel sheet from 720°~600° C. to a quenching end temperature ($T_E$) of 310° C. or lower at a cooling rate ($\alpha$) of 30°~250° C./sec, coiling the steel sheet at a temperature of from room temperature to 150° C., wherein said quenching after the recrystallization and grain growth, and said coiling constitute a first discrete line in the process, and said first discrete line is followed by a second discrete line, namely comprising reheating the steel sheet to a molten zinc bath temperature, dipping the steel sheet into the molten zinc bath, thereby zinc-plating the steel sheet, reheating the steel sheet to 500°~600° C. for 5·20 seconds, thereby conducting an alloying treatment, cooling the steel sheet to 350° C. at a cooling rate of 250°~5° C./sec, cooling the steel sheet at an average cooling rate of $0.7\times C.R_2$, where $C.R_2$ is defined by the following formula (1), in a temperature region of from below 350° C. to 300° C. and then cooling the steel sheet at an average cooling rate of $0.7\times C.R_3$, where $C.R_3$ is defined by the following formula (2), in a temperature region of from below 300° C. to 285°~220° C.:

$$C.R_{2S} \leqq C.R_2 \leqq C.R_{2h} \quad \text{(1)}$$

$$C.R_{3S} \leqq C.R_3 \leqq C.R_{3h} \quad \text{(2),}$$

where $$C.R_{2S}=(-2.983\times(1/\alpha)+0.168)\times\exp(-0.0130\times T_E+5.18)$$

$$C.R_{2h}=(-4.185\times(1/\alpha)+0.263)\times\exp(-0.0130\times T_E+6.06)$$

$$C.R_{3S}=(-0.695\times(1/\alpha)+0.0392)\times\exp(-0.0130\times T_E+5.18)$$

$$C.R_{3h}=(-1.313\times(1/\alpha)+0.0741)\times\exp(-0.0130\times T_E+6.06)$$

$\alpha$: cooling rate of quenching before supercooling (°C./sec)

$T_E$: quenching end temperature (°C.), where 200°0 C. is made to be the lowest temperature even if it is lower than 200° C.

$C.R_{2S}$: minimum average cooling rate in a temperature region of from below 350° C. to 300° C. (°C./sec)

$C.R_{2h}$: maximum average cooling rate in a temperature region of from below 350° C. to 285°~220° C. (°C./sec)

$C.R_{3h}$: maximum average cooling rate in a temperature region of from below 300° C. to 285°~220° C. (°C./sec).

5. A process according to claim 1, 2, 3 or 4, wherein the cold rolled steel sheet contains 0.5~2.0 of B in terms of B/N.

6. A process according to claim 1, 2, 3 or 4, wherein the molten zinc bath temperature is in the range of from 450° C. to 500° C.

7. A process according to claim 1, 2, 3 or 4, wherein the cooling rate ($\alpha$) is in the range of from 50° C./sec to 250° C./sec.

8. A process according to claim 1 or 2, wherein the quenching end temperature ($T_E$) is in the range of from 300° C. to 200° C.

9. A process according to claim 3 or 4, wherein the quenching end temperature is in the range of from 300° C. to room temperature.

* * * * *

UNITED STATES PATENT AND TRADEMARK OFFICE

CERTIFICATE OF CORRECTION

PATENT NO. : 4,960,158

DATED : October 2, 1990

INVENTOR(S) : Teruaki YAMADA et al.

It is certified that error appears in the above-identified patent and that said Letters Patent is hereby corrected as shown below:

Column 15, lines 28 and 30, change "200°C." to --220°C.--.

Column 16, lines 35 and 37, change "200°C." to --220°C.--.

Column 18, line 8, change "200°0C." to --220°C.--;

line 10, change "200°C." to --220°C.--;

line 15, change "285° ~ 220°C." to --300°C.--;

UNITED STATES PATENT AND TRADEMARK OFFICE

CERTIFICATE OF CORRECTION

PATENT NO. : 4,960,158

DATED : October 2, 1990

INVENTOR(S) : Teruaki Yamada et al

It is certified that error appears in the above-identified patent and that said Letters Patent is hereby corrected as shown below:

Column 18, between line 16 and 17, insert the following:

--$C.R_{3S}$: minimum average cooling rate in a temperature region of from below 300°C. to 285° ~ 220°C. (°C./sec)--.

Signed and Sealed this

Third Day of March, 1992

*Attest:*

*Attesting Officer*

HARRY F. MANBECK, JR.

*Commissioner of Patents and Trademarks*